US010750266B2

(12) United States Patent
Meyer et al.

(10) Patent No.: US 10,750,266 B2
(45) **Date of Patent: *Aug. 18, 2020**

(54) MICROPHONE CONNECTOR, ASSEMBLY AND SYSTEM

(71) Applicant: Shure Acquisition Holdings, Inc., Niles, IL (US)

(72) Inventors: Christopher Meyer, Libertyville, IL (US); Walter Harwood, Streamwood, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/164,393

(22) Filed: Oct. 18, 2018

(65) Prior Publication Data

US 2019/0116407 A1 Apr. 18, 2019

Related U.S. Application Data

(63) Continuation of application No. 15/423,410, filed on Feb. 2, 2017, now Pat. No. 10,158,931.

(51) Int. Cl.

| | |
|---|---|
| ***H04R 1/04*** | (2006.01) |
| ***H04R 3/00*** | (2006.01) |
| ***H04R 1/08*** | (2006.01) |
| ***H04R 1/06*** | (2006.01) |

(52) U.S. Cl.

CPC ..... *H04R 1/04* (2013.01); *H04R 1/08* (2013.01); *H04R 3/00* (2013.01); *H04R 1/06* (2013.01); *H04R 1/086* (2013.01); *H04R 2410/03* (2013.01)

(58) Field of Classification Search

None

See application file for complete search history.

(56) References Cited

U.S. PATENT DOCUMENTS

| | | | |
|---|---|---|---|
| 4,261,628 | A | 4/1981 | Gallagher |
| 6,116,945 | A | 9/2000 | Davis |
| 6,430,298 | B1 | 8/2002 | Kettl |

(Continued)

FOREIGN PATENT DOCUMENTS

| | | |
|---|---|---|
| CN | 203632828 | 6/2014 |
| CN | 204615057 | 9/2015 |
| EP | 1744408 | 1/2007 |

OTHER PUBLICATIONS

Neutrik, "Application Note: 8+2 pole XLR". pp. 1-2. 2017.*

(Continued)

*Primary Examiner* — Qin Zhu

(74) *Attorney, Agent, or Firm* — Neal, Gerber & Eisenberg LLP

(57) ABSTRACT

A microphone connector assembly comprises a receptacle and a sleeve. The receptacle includes a housing, a first cavity formed within the housing, a frame, a protrusion formed on the frame, and a first electrical block supported by the frame and positioned within the first cavity. The sleeve includes an outer shell, a second cavity formed within the outer shell, a keyway, and a second electrical block positioned within the second cavity. The sleeve is insertable into the receptacle such that the protrusion enters the keyway and the first and second electrical blocks engage one another.

20 Claims, 9 Drawing Sheets

(56) References Cited

U.S. PATENT DOCUMENTS

| | | | | |
|---|---|---|---|---|
| 8,588,451 | B2 * | 11/2013 | Matsunaga | H04R 19/016 381/174 |
| 2004/0264726 | A1 | 12/2004 | Gauger | |
| 2005/0063557 | A1 * | 3/2005 | Akino | H04R 1/38 381/174 |
| 2007/0237344 | A1 | 10/2007 | Oster | |
| 2008/0144875 | A1 * | 6/2008 | Akino | H04R 1/04 381/361 |
| 2009/0154738 | A1 | 6/2009 | Pal | |
| 2014/0273577 | A1 | 9/2014 | Puluc | |
| 2015/0270638 | A1 | 9/2015 | Yoshino | |
| 2015/0340805 | A1 | 11/2015 | Jordan | |
| 2015/0349458 | A1 | 12/2015 | Horiuchi | |
| 2016/0373845 | A1 | 12/2016 | Akino | |
| 2017/0214191 | A1 | 7/2017 | Lane | |

OTHER PUBLICATIONS

Shure, Microflex-Gooseneck Microphones and Accessories, 2014, Shure Incorporated, pp. 2-5.

Order and Specification Page for 1pc 10 Pin 4 Hole Socket Plug XLR Connector 16mm 10Pin Panel Mount Aviation Radio Connector, obtained from website <DHgate.com> on Aug. 26, 2016.

Specification Page for High-Performance Dual-Capsule Tube Microphone, obtained from website <http://basoinvest.com/project-sudi-mcrophones/P820-Tube-b49.php> on Aug. 26, 2016.

Press Release for Neutrik USA's 10-pin XLR line, posted on website <www.tvtechnology.com> on Oct. 19, 2015.

Product Catalog for Televic Flush Mount Equipment Integrated Flushmount Panels, Televic Conference, at least as ealy as Aug. 26, 2016.

Order and Specification Page for Televic DML5500/XLR/A Delegate microphone panel with GSM immunity on XLR connector, supplied with gooseneck microphone TGM2240, obtained from website <https://www.audiocity2u.com/Conference/TELEVIC/TELEVIC-DML5500XLRA.html> at least as early as Aug. 26, 2016.

International Search Report and Written Opinion for PCT/US2018/016166 dated Mar. 27, 2018.

* cited by examiner

MICROPHONE CONNECTOR, ASSEMBLY AND SYSTEM

CROSS-REFERENCE

This application is a continuation of U.S. patent application Ser. No. 15/423,410, filed on Feb. 2, 2017, the contents of which are herein disclosed by reference in their entirety.

TECHNICAL FIELD

This application generally relates to microphones and microphone connectors. In particular, this application relates to a microphone connector that includes a sleeve and a receptacle having keyed and releasably lockable engagement that is capable of transmitting both audio signals from the connected microphone and lighting signals to lights onboard of the connected microphone to indicate a mode or status of the microphone.

BACKGROUND

Many varieties of microphones are employed in a variety of sound reinforcement applications where audio from a sound source (such as a human speaking) is captured, transmitted and amplified to listeners via appropriate amplification and speaker systems. Microphones can be used in a variety of such applications. Microphone connectors typically connect a microphone to a cable or plug such that an electrical connection is made between the microphone and downstream audio components (such as mixers and amplifiers) to which the audio signal captured by the microphone is delivered.

In some applications, such as conferencing environments, larger numbers of microphones are utilized to capture audio from a large number of audio sources. For example, sound reinforcement in environments such as conference rooms, boardrooms, video conferencing applications, and the like, can involve the use of microphones for capturing sound from many audio sources active in such environments. Such audio sources may include humans speaking, for example. The captured sound may be disseminated to a local audience in the environment through amplified speakers (for sound reinforcement), or to others remote from the environment (such as via a telecast and/or a webcast).

Given the larger numbers of microphones utilized in these and other types of applications, it is often desirable to not have all of the microphones active at one time, so as to avoid undesirable results such as feedback, picking up room noise, etc. Therefore, in applications with large numbers of microphones, often system controls are utilized which activate one or several microphones at one time, to pick up audio only from active sources, such as active speakers in a large group of people. In conjunction with selective activation of microphones, it can be desirable to indicate to the individuals using such microphones a status or mode of the microphones (such as when the microphones are active, or "on", and when the microphones are inactive, or "muted", for example). Therefore, conferencing systems may include visual indicators to indicate statuses of various microphones in the system so that users of the system know which microphones are active at any time, and which are not.

It can be desirable for individual microphones in such systems to include visual indicators, such as lighting, on the microphone itself, to indicate the status of such microphone to a user of the microphone. However, adding lighting to a microphone introduces challenges relative to electromagnetic interference, radio frequency interference and other noise which can be interjected into the system. For example, users with cell phones placed nearby such microphones can introduce radio frequency or GSM interference into the system due to deficiencies in the electrical design of the microphone. Robustness of the microphone connection can be challenging, so as to ensure that the microphone can be easily connected, cannot be inadvertently removed or have its connection disrupted, and is not negatively impacted by unwanted electromagnetic interference.

Accordingly, there is an opportunity for systems that address these concerns. More particularly, there is an opportunity for a microphone connector that includes a keyed and lockable engagement and is capable of transmitting both audio signals from the connected microphone and lighting signals to lights onboard of the connected microphone to indicate a mode or status of the microphone, while reducing or eliminating unwanted interference.

SUMMARY

The present invention is intended to solve the above-noted problems by providing microphone connectors and microphones that are designed to, among other things: (1) provide keyed and lockable engagement between the portions of the connector, (2) simultaneously permit downstream transmission of audio captured by the microphone and upstream transmission of lighting signals to one or more lights mounted on the connected microphone and (3) minimize or eliminate unwanted electromagnetic interference.

In an embodiment, a microphone connector assembly comprises a receptacle and a sleeve. The receptacle comprises a housing, a first cavity formed within the housing, a frame positioned within the first cavity, and a protrusion formed on the frame. The receptacle further comprises a first electrical block supported by the frame and positioned within the first cavity. The sleeve comprises an outer shell, a second cavity formed within the outer shell and a keyway formed in the outer shell and positioned within the second cavity. The sleeve further comprises a second electrical block positioned within the second cavity, wherein the sleeve is insertable into the receptacle such that (i) the protrusion enters the keyway and (ii) the first and second electrical blocks engage one another.

In another embodiment, a microphone comprises a head and a microphone body. The head includes a cartridge, and the microphone body supports the head. The microphone further comprises a sleeve connected to the microphone body. The sleeve comprises an outer shell, a cavity formed within the outer shell, and a keyway formed on an inner surface of the outer shell. The sleeve further comprises an electrical block positioned within the cavity, the electrical block comprising an array of contact positions configured to house a plurality of electrical contacts. The sleeve further comprises a first protrusion extending from the inner surface of the outer shell.

In yet another embodiment, a microphone connector assembly comprises a sleeve connected to a microphone body of a microphone. The sleeve comprises an outer shell, a cavity formed within the outer shell, and a keyway formed on an inner surface of the outer shell. The sleeve further comprises an electrical block positioned within the cavity, the electrical block comprising an array of contact positions configured to house a plurality of electrical contacts. The sleeve further comprises a first protrusion extending from the inner surface of the outer shell.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
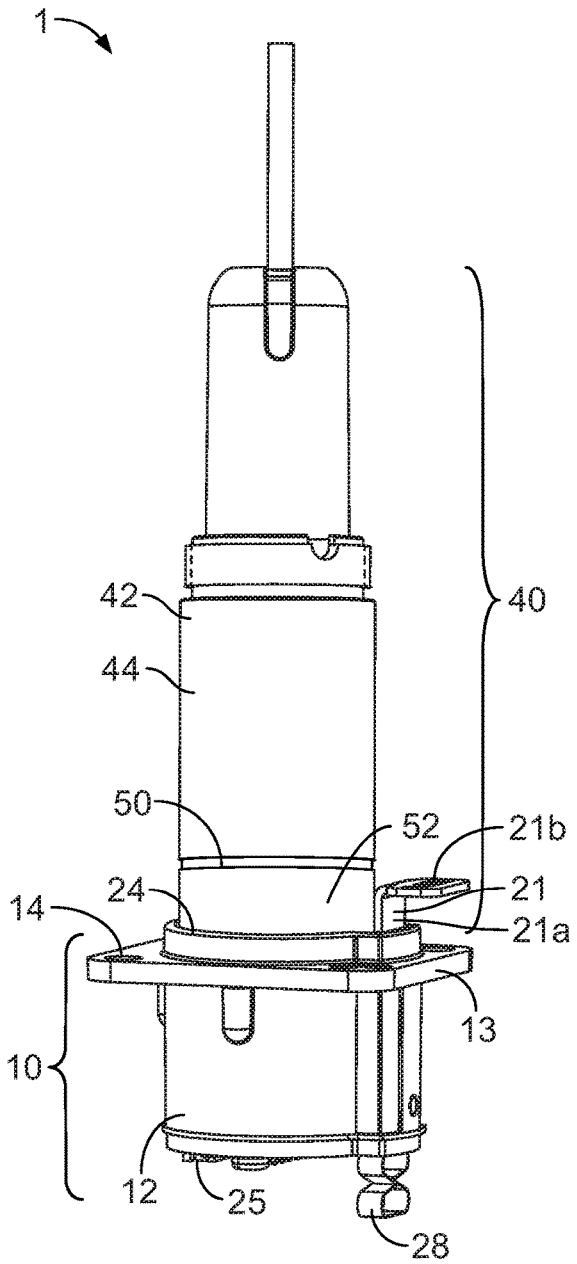
FIG. 1 is a perspective view of a microphone connector of the present invention, including a sleeve and a receptacle, shown in a connected position.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

With respect to the exemplary systems, components and architecture described and illustrated herein, it should also be understood that the embodiments may be embodied by, or employed in, numerous configurations and components, including one or more systems, hardware, software, or firmware configurations or components, or any combination thereof, as understood by one of ordinary skill in the art. Accordingly, while the drawings illustrate exemplary systems including components for one or more of the embodiments contemplated herein, it should be understood that with respect to each embodiment, one or more components may not be present or necessary in the system.

Figure 2:
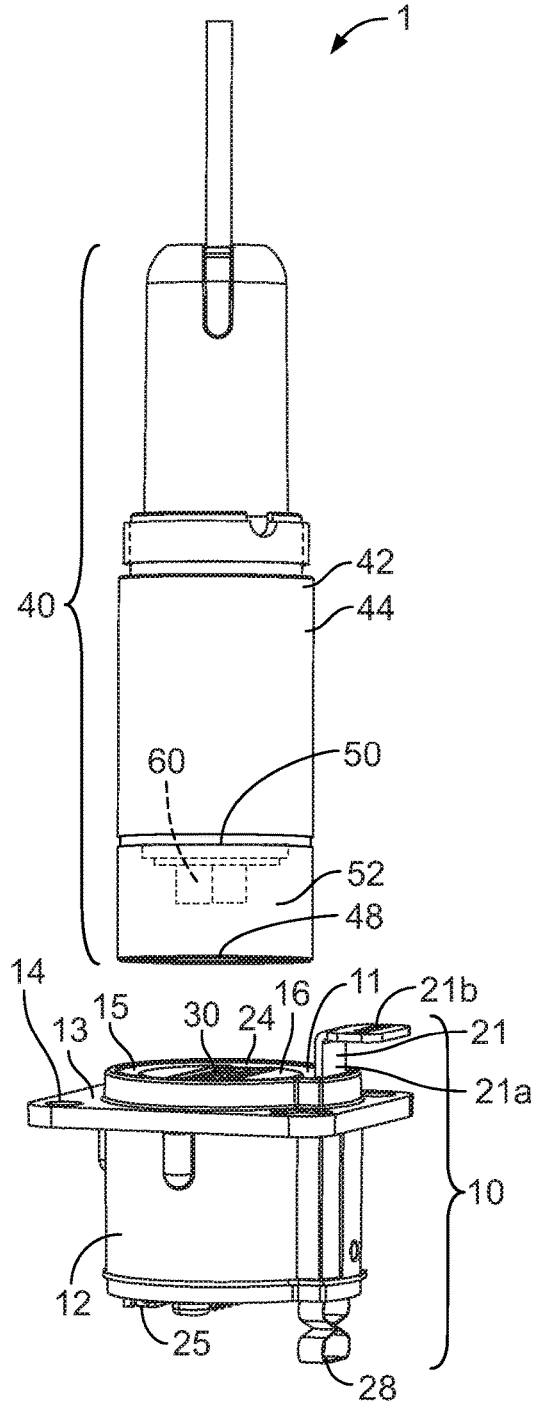
FIG. 2 is a perspective view of the microphone connected of FIG. 1, shown in a disconnected position.

Turning to FIGS. 1 and 2, a microphone connector 1 according to an embodiment of the present invention is depicted. FIG. 1 depicts the microphone connector 1 in a connected position, while FIG. 2 depicts the microphone connector 1 in a disconnected position. The microphone connector 1 comprises two mating portions, a receptacle 10 and a sleeve 40, which mate with one another as described herein, and which operate to cause the connection and disconnection of the microphone connector 1. The receptacle 10 receives the sleeve 40 to complete the connection of the microphone connector 1, as depicted in FIG. 1, and described further herein.

Figure 11:
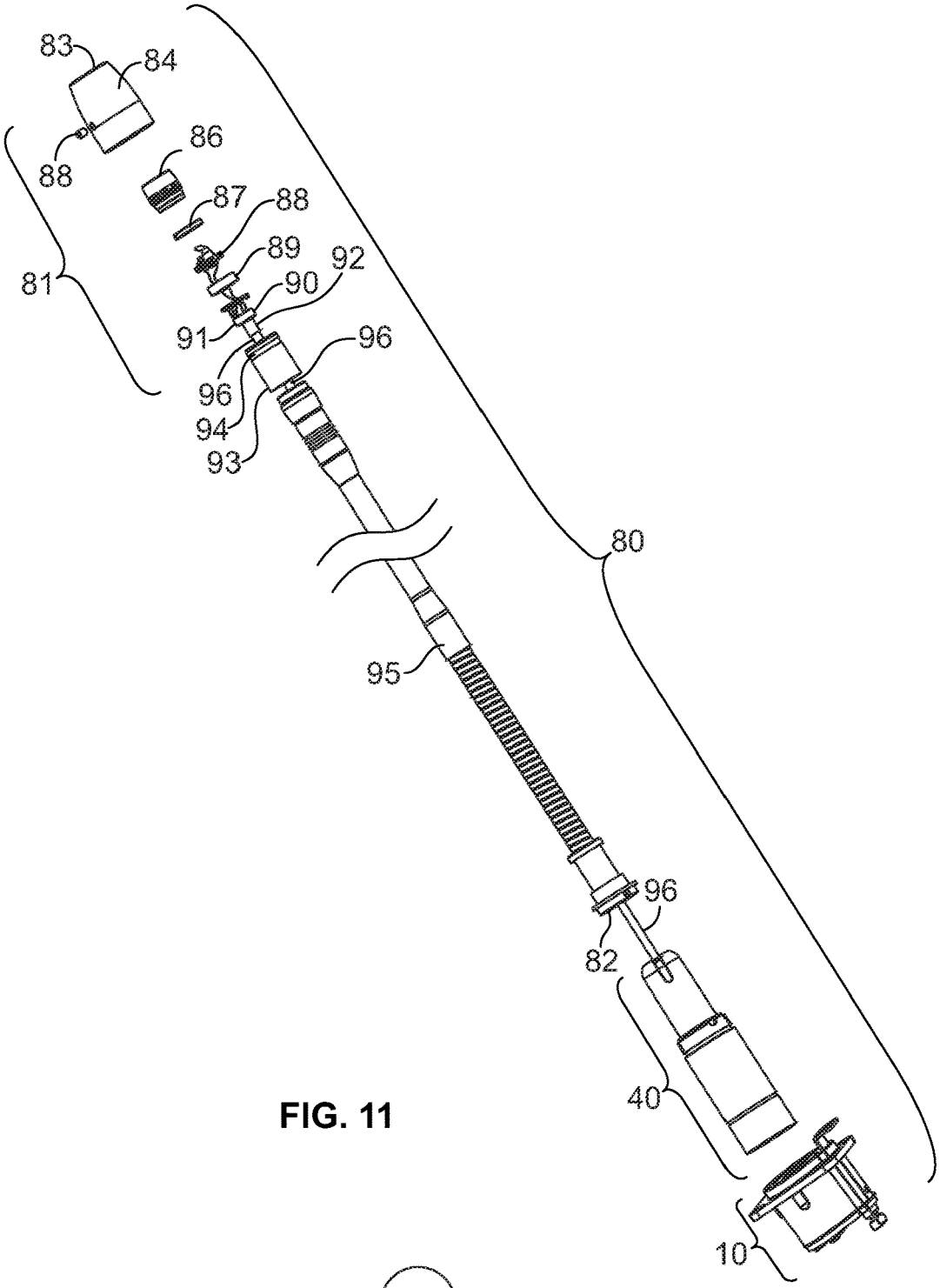
FIG. 11 is an exploded perspective view of a microphone assembly of the present invention, including a microphone having a sleeve engageable with a receptacle.

Generally, the sleeve 40 is connected to a microphone 80 (as shown in FIG. 11), and can be in communication with the microphone 80 via a cable or other connector connecting the two, or alternatively, as shown in FIG. 11, the sleeve 40 can be directly connected to, or integrally formed with the microphone 80 so as to be positioned, for example, proximate an end of the microphone. In an embodiment, the receptacle 10 can be configured so as to be connected to, or mounted on, a variety of surfaces where it is desirable for the microphone to be connected. For example, the receptacle 10 can be surface mounted on a table, lectern, podium, desk, or other appropriate surface, with the wiring and cabling from the receptacle 10 connecting the receptacle 10 to other components of a sound reinforcement system, such as a mixer, amplifier, etc.

The sleeve 40 generally comprises an outer shell 42 having an outer surface 44 and an inner surface 46. In an embodiment, the outer shell 42 is rigid, and generally has a cylindrical shape, with a circular cross-section. The outer shell 42 forms a thin-walled housing between the outer surface 44 and the inner surface 46. A support 50 is mounted inside of the sleeve 40, and spaced from a distal end 48 of the sleeve 40. The support 50 is structurally supported by the sleeve 40 and may be connected to, or integrally formed with the sleeve 40. For example, the support 50 may be connected to the inner surface 46 of the sleeve 40. Because the support 50 is spaced from the distal end 48 of the sleeve 40, a cavity 52 is formed in the sleeve 40, proximate the distal end 48.

The cavity 52 is generally formed by the inner surface 46 of the outer shell 42, and the support 50. In an embodiment, the cavity 52 is generally cylindrical in shape formed by the contours of the inner wall 46 of the outer shell 42. The sleeve 40 further includes an electrical block 60, which houses the electrical contacts and forms the electrical connection when the sleeve 40 is mated with the receptacle 10. The electrical block 60 is described in greater detail with reference to FIGS. 10 and 12. In an embodiment, the electrical block 60 is positioned inside the cavity 52, and supported therein. The electrical block 60 may be connected to and supported by the support 50, or any other appropriate structures of the sleeve 40, so as to be positioned and held within the cavity 52. As is described in greater detail with reference to FIGS. 3 and 4, the receptacle 10 has a corresponding electrical block 30, which is positioned near an opening 24 of the receptacle 10. As seen in FIGS. 1 and 2, when the sleeve 40 is brought into communication with the receptacle 10, and the two pieces of the microphone connector 1 are connected, the electrical block 60 of the sleeve 40 comes into communication with electrical block 30 of the receptacle 10, thereby forming the electrical connections of the microphone connector 1.

Figure 10A:
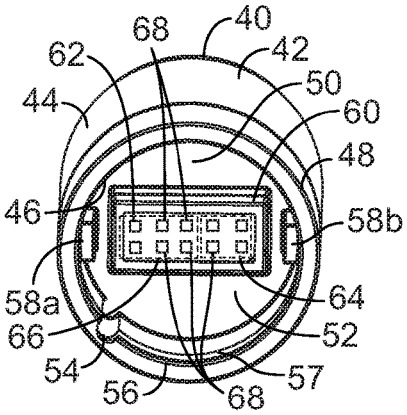
FIG. 10A is a perspective end view of a sleeve of a microphone connector of the present invention, showing a keying system of the microphone connector.

The electrical block 60 includes a plurality of openings, or contact positions 68 (seen in FIG. 10A), which may house the electrical contacts 62 of the sleeve 40. The openings, or contact positions 68, are entry points for the male contacts 32 on the electrical block 30 of receptacle 10. In an embodiment, the electrical block 60 of the sleeve 40 forms an array or matrix of contact positions 68, some of which may house the audio contacts 64 and others of which may house the lighting contacts 66. Thus, the contacts 62 of the sleeve 40, specifically the audio contacts 64 and the lighting contacts 66 may be positioned proximate to, and within the contact positions 68 of the electrical block 60 so as to be in communication with the contacts 32 of the receptacle 10 when the sleeve 40 and receptacle 10 are mated or connected. As seen in FIG. 10A, the contact positions 68 in the electrical block 60 are arranged in a rectangular shaped array, having two rows of five contact positions 68, or forming a 2 by 5 array of contact positions 68 in the connector 60. In other embodiments, other geometric configurations of the contact positions 68 may be utilized. Moreover, the electrical block 60 of the sleeve 40 may take on various geometric arrangements and configurations as well, which may be complimentary to the geometric configurations of the electrical block 30 of the receptacle 10 to support connection there between.

Figure 3A:
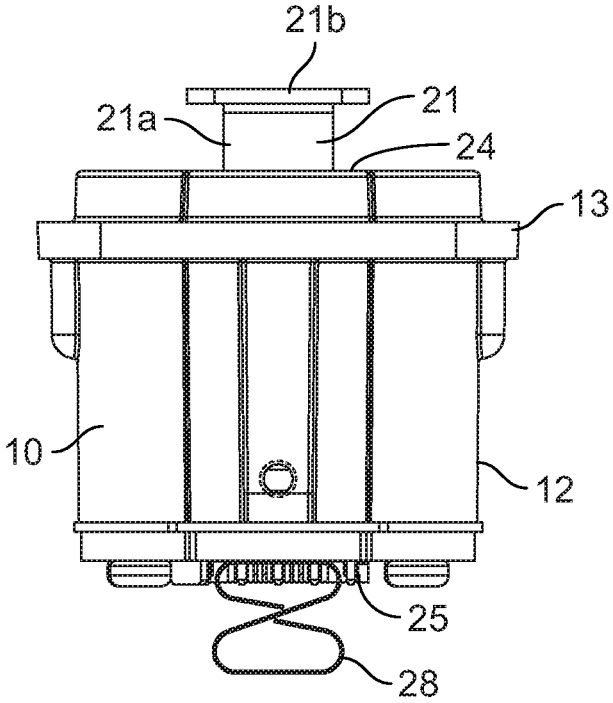
FIG. 3A is front view of a receptacle of the microphone connector of FIGS. 1 and 2.
Figure 3B:
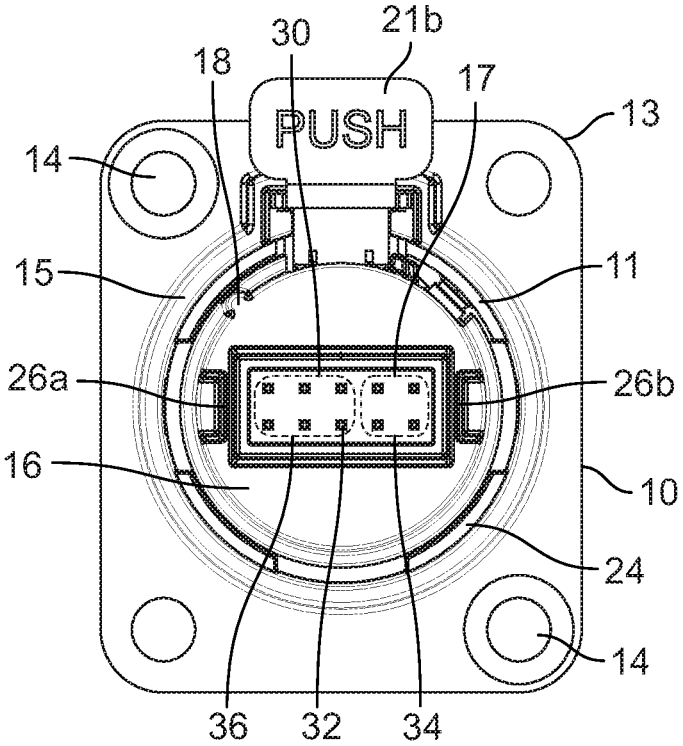
FIG. 3B is a top view of the receptacle of FIG. 3A.
Figure 4:
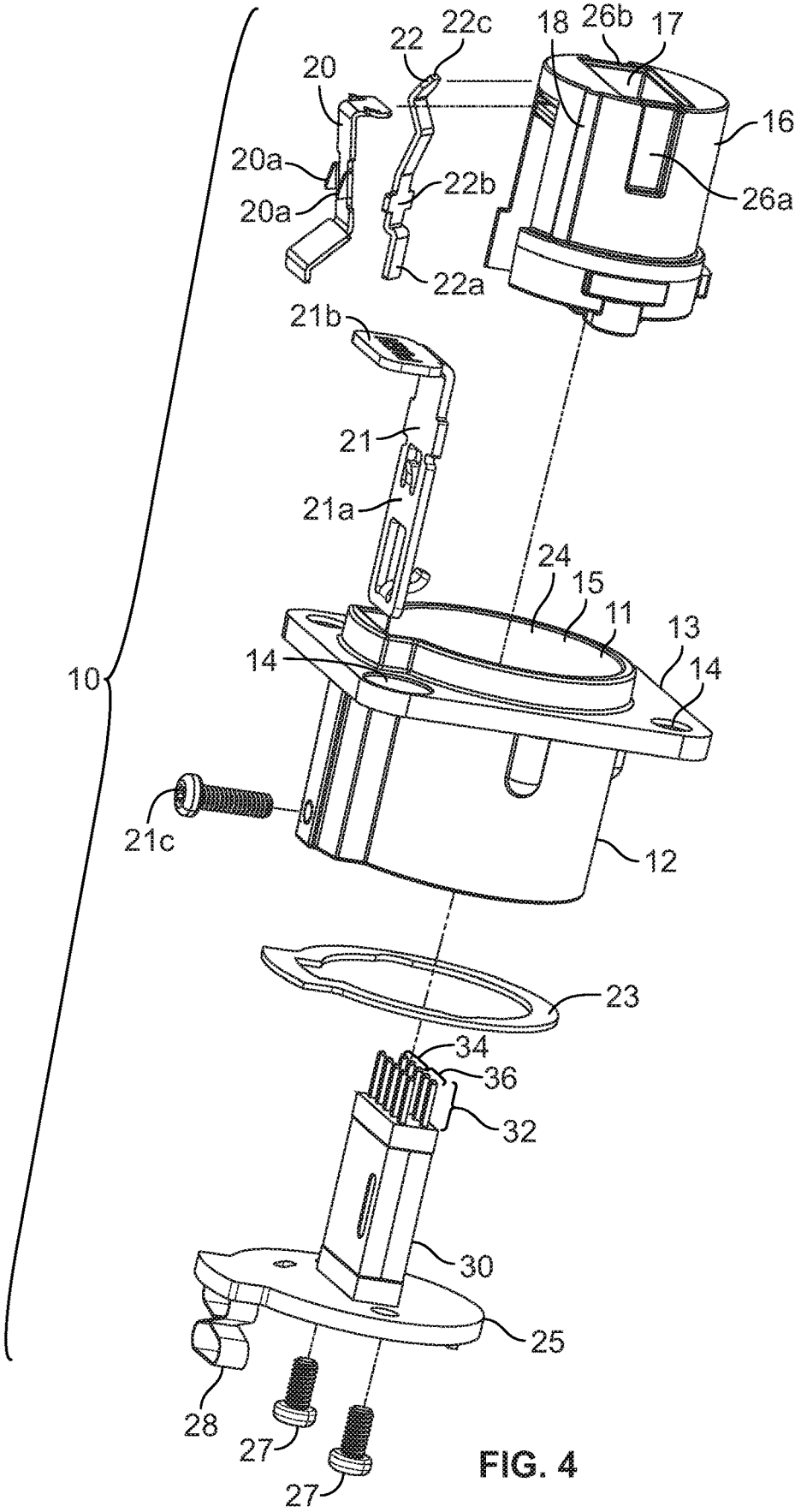
FIG. 4 is an exploded perspective view of the receptacle of FIGS. 3A and 3B.

Turning to FIGS. 3A, 3B and 4, detailed views of the receptacle 10 are shown. The receptacle 10 generally is formed by an outer housing 12 in which the components of the receptacle 10 are supported and positioned. The receptacle 10 has an opening 24 on one end, into which the sleeve 40 is received. Near the opening 24, the housing 12 of the receptacle 10 may include an optional flange 13 which extends from the housing 12 and aids in mounting of the receptacle 10.

The flange 13 may include one or more mounting holes 14 which receive mounting hardware, such as screws, used to mount the receptacle 10 to various surfaces. For example, an appropriately sized hole may be created in a mounting surface (such as in a desk, lectern, conference table, etc.) so as to accept the housing 12 of the receptacle 10 through the hole, and allow the flange 13 to abut, or rest against the mounting surface. The receptacle 10 can then be affixed to the mounting surface through the use of mounting hardware inserted through the holes 14 of the flange 13 and into the mounting surface. In an embodiment, appropriately sized holes may be drilled into the desired mounting surface, and screws may be utilized by inserting the screws through the holes 14 in the flange 13, into the drilled holes and affixing the flange 13 against the mounting surface. A variety of other mounting methods may be used to affix the receptacle 10 to various surfaces.

The receptacle 10 further includes an internal frame 16 that is positioned within a cavity 15 formed inside of the receptacle 10. The frame 16 is structurally connected to the housing 12 of the receptacle 10, and supported thereby, as depicted in the figures. In an embodiment, the frame 16 may be a separate component from the housing 12, but is supported by the housing 12 when the two are interconnected (as seen in FIG. 4). Alternatively, the frame 16 may be integrally formed with the housing 12 so as to be a single, unitary component. The interior of the housing 12 of the receptacle 10 forms a cavity 15, as seen in FIGS. 3B and 4. In an embodiment, the frame 16 is positioned partially or entirely within the cavity 15. The cavity 15 is formed by an inner wall 11 of the housing 12, and is generally cylindrical in shape.

In an embodiment, the frame 16 supports an electrical block 30 of the receptacle 10. The electrical block 30 may be supported on an interior of the frame 16, and protrudes through an orifice 17 in the end of the frame 16 proximate the opening 24 of the receptacle 10. The electrical block 30 of the receptacle 10 includes a plurality of electrical contacts 32, which in an embodiment comprise electrical pins extending from the block 30. In an embodiment, the electrical contacts 32 of the block 30 in the receptacle 10 are male, while the corresponding contacts 62 of the sleeve 40 are female. In alternative embodiments, the contacts 32,62 may be of reverse gender, or may comprise other forms of electrical contact points, which complete electrical connections between the electrical blocks 30,60, when the receptacle 10 and sleeve 40 are connected and mated.

Figure 5A:
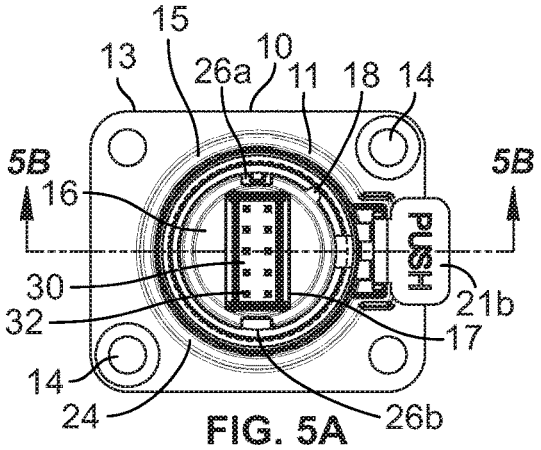
FIG. 5A is a top view of an embodiment of a microphone connector of the present invention, shown in a locked or engaged position.

The receptacle 10 may further include a latch 20 for engaging complimentary latch engaging structure on the sleeve 40 to keep the receptacle 10 and sleeve 40 mechanically engaged when the two are connected together as shown in FIG. 1. In an embodiment, the latch 20 is a metal bar having a tooth 20*a* or teeth 20*a* thereon. The latch 20 is engaged partially inside of the frame 16, and is capable of being flexed so as to selectively bring the teeth 20*a* into mechanical engagement with the sleeve 40. When the latch 20 is engaged, the sleeve 40 is locked in place with the receptacle 10. An actuator 21 may be provided to operate the latch 20. The actuator 21 may comprises a sliding metal bar 21*a* that includes a tab 21*b* for actuation of the actuator 21, as seen in FIG. 3B. The tab 21*b* may include a demarcation, such as the word "PUSH", which provide instructions on how the actuator 21 is operated. In an embodiment, pushing the tab 21*b* causes the metal bar 21*a* to slide inward into the cavity 15, and to come in contact with the latch 20, thereby causing the latch 20 to flex. The flexing of the latch 20 causes the teeth 20*a* to move out of engagement with the sleeve 40, and in this way the actuator 21 operates to actuate the latch 20 between a locked and unlocked position. In an alternative embodiment, the actuator 21 comprises a screw 21*c* which is advanced or backed out of a hole in the side of the housing 12 of the receptacle 10, as seen in FIG. 4. Like the metal bar 21*a*, the screw actuator 21*c* operates to flex the latch 20 between a locked and unlocked position. The actuation of the latch 20, and the operation of the locking mechanism is described in greater detail in relation to FIGS. 5 and 6.

The receptacle 10 further includes structures forming part of a keying system, which works to ensure that the microphone connector 1 can only be connected in one orientation. As seen in FIG. 3B, the receptacle 10 includes a protrusion 18. The protrusion 18 mates with a corresponding groove or keyway (shown in greater detail in FIGS. 10A through 10D) in the sleeve 40, such that the sleeve 40 may only be inserted into the receptacle if the protrusion 18 and the keyway are aligned. In an embodiment, the protrusion 18 is located within the cavity 15, and connected to, or integrally formed upon the frame 16, extending therefrom into the cavity 15. In alternative embodiments, the protrusion 18 may be located in other areas of the receptacle 10, such as on the inner wall 11 of the housing 12. The receptacle 10 also includes grooves or keyways 26*a,b*, which also mate with corresponding protrusions (shown in greater detail in FIGS. 10A through 10D) in the sleeve 40, to make the keying system more robust. In an embodiment, the keyways 26*a,b*, are located on opposing sides of the frame 16, adjacent the electrical block 30. Like the other structures of the keying system, the keyways 26*a,b* ensure proper alignment of the sleeve 40 with the receptacle 10 during insertion, by mating with the protrusions of the sleeve 40. The keying system operates to properly align the electrical blocks 30,60 of the receptacle 10 and sleeve 40, to ensure that proper electrical connections between the contacts 32,62 are made.

As seen in FIG. 4, the receptacle 10 further comprises a printed circuit board (or PCB) 25, to which the electrical block 30 is connected and supported. The PCB 25 provides mechanical support for the electrical block 30, as well as electrical access to the contacts 32 of the electrical block 30. Thus, via the PCB 25, the electrical connections of the receptacle 10 can be completed, and the receptacle 10 can be connected to other downstream audio equipment, such as amplifiers, mixers, etc. to which the connector 1 needs to be connected. The PCB 25 is connected and secured to the housing 12 of the receptacle 10. In an embodiment, the PCB 25 is affixed to the housing 12 via one or more screws 27 that pass through holes in the PCB 25 and into corresponding holes in the housing 12, so as to secure the PCB 25 to the housing 12. However, the PCB 25 may be secured to the housing 12 in a variety of other ways. A grounding tab 28 of the receptacle 10 may further be attached to the PCB 25, as seen in FIG. 4. An optional gasket 23 may be provided between the PCB 25 and the housing 12, so as to insulate the PCB 25 from the housing 12. The grounding tab 28 is an optional feature of the present invention, and may be omitted in various embodiments. The gasket 23 may comprise a foam gasket, or may be made of any other suitable insulating material, including rubber, vinyl, paper, etc.

The receptacle 10 may further include a contactor 22. The contactor 22 may comprise a flexible metal bar, which ensures an electrical grounding connection between the frame 16 and the housing 12 of the receptacle 10, and the structures of the sleeve 40. Specifically, the contactor 22 may be inserted in between the frame 16 and the housing 12 by flexing the contactor 22, inserting the contactor 22 between the frame 16 and the housing 12, and releasing the contactor 22. The natural resilience of the contactor 22 causes it to stay in contact with both the frame 16 and the housing 12. The contactor 22 maintains a grounding connection between the frame 16, the housing 12, the other components of the receptacle 10, and the components of the sleeve 40, which improves the electromagnetic insulation and shielding of the microphone connector 1, as described herein. The configuration and operation of the contactor 22 is described in greater detail in relation to FIGS. 9A and 9B.

Figure 5B:
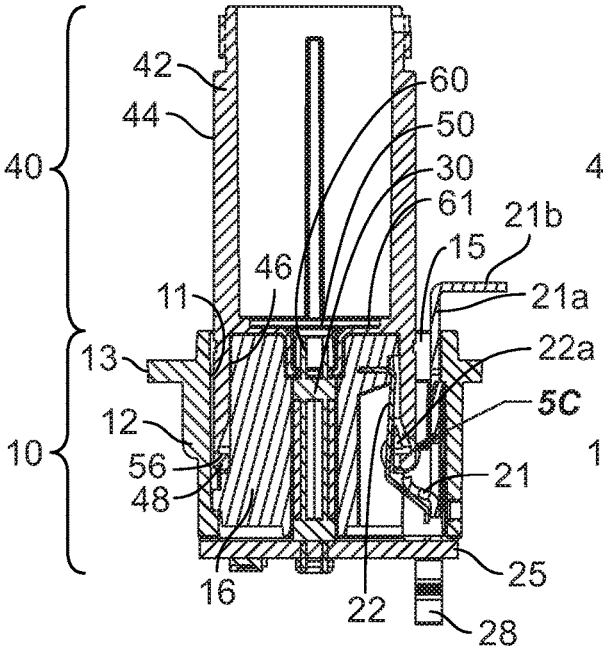
FIG. 5B is a cross-sectional view of the microphone connector of FIG. 5A, taken along section 5B-5B.
Figure 5C:
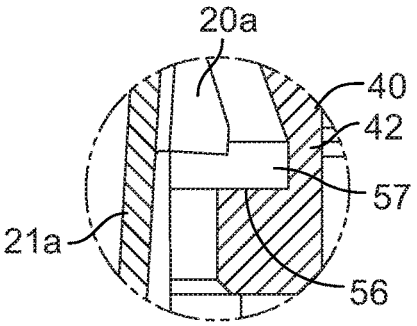
FIG. 5C is an enlarged detail of area 5C of the microphone connector of FIG. 5B.

Turning to FIGS. 5A-C and 6A-C, detailed description of the operation of a locking mechanism of an embodiment of the microphone connector 1 is depicted. In the depicted embodiment, the locking mechanism comprises a latch 20 which is operated by an actuator 21 which comprises a sliding metal bar 21*a*. In FIG. 5B, a cross-section of the receptacle 10 (taken along line 5B-5B of FIG. 5A) is depicted, with the sleeve 40 connected to the receptacle 10. As seen in FIG. 5B, the sleeve 40 is inserted into the receptacle 10 until the latch 20 is engaged in a locked position. Specifically, as seen in greater detail in FIG. 5C, the teeth 20*a* of the latch 20 passes along and over the inner wall 11 of the housing 12 of the receptacle 10, until the teeth 20*a* reach a lip 56 formed in the inner surface 46 of the outer shell 42 of the sleeve 40. The resilience of the flexible latch 20 causes it to return to its straightened (non-flexed) state, and in doing so, causes the teeth 20*a* of the latch 20 to enter a groove 57 formed by the lip 56 in the inner surface 46. When the teeth 20*a* enter the groove 57, they engage the lip 56 so as to prevent the sleeve 40 from being removed or extracted from the receptacle 10. In this way, the latch 20, teeth 20*a*, lip 56 and groove 57 support a locking mechanism of the connector 1. More specifically, the lip 56 forms a latch engaging structure on the sleeve 40. In alternative embodiments other latch engaging structures may be utilized, including tabs, detents, teeth, ribs, screw threads, or other mechanical structures capable of releasably engaging the latch 20.

Figure 6A:
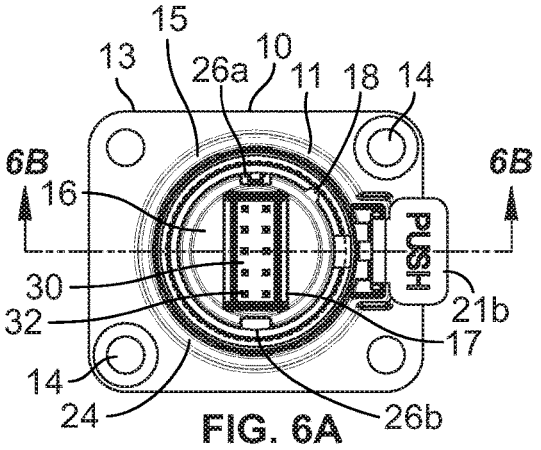
FIG. 6A is a top view of the microphone connector of FIG. 5A, shown in an unlocked or disengaged position.
Figure 6B:
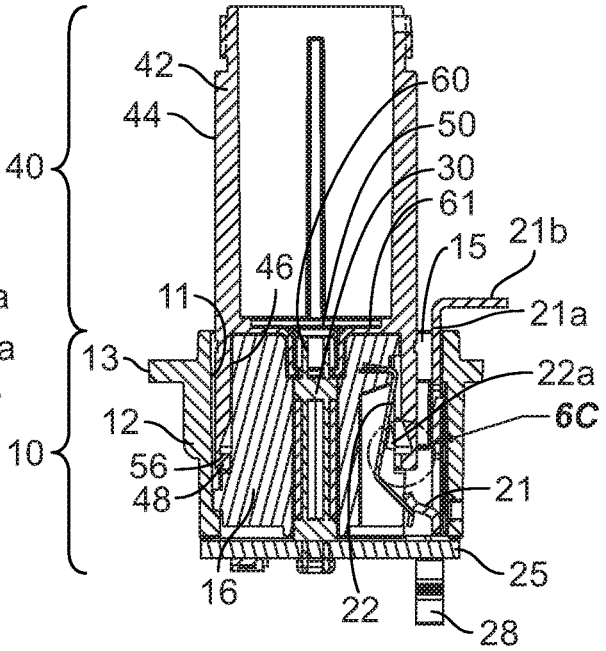
FIG. 6B is a cross-sectional view of the microphone connector of FIG. 6A, taken along section 6B-6B.
Figure 6C:
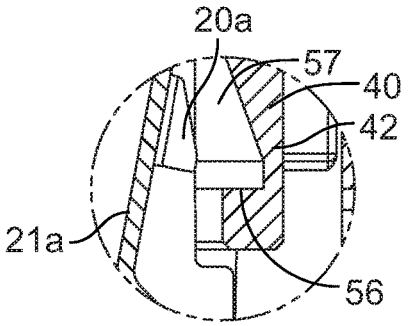
FIG. 6C is an enlarged detail of area 6C of the microphone connector of FIG. 6B.
Figure 7A:
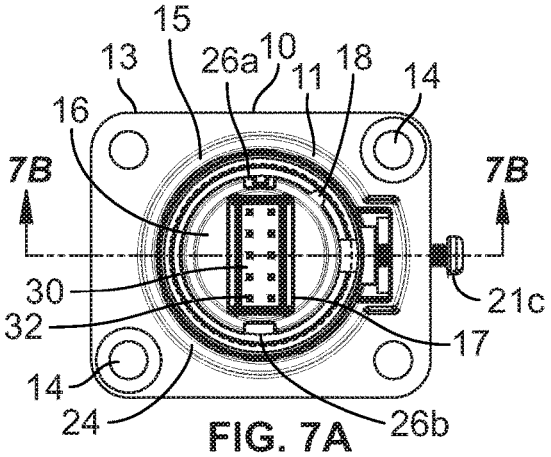
FIG. 7A is a top view of an alternative embodiment of a microphone connector of the present invention, shown in a locked or engaged position.

Removal and extraction of the sleeve 40 from the receptacle 10 can only be accomplished by disengagement of the latch 20, as shown in FIG. 6A-C. Disengagement of the latch 20 is largely the reverse of the engagement process. In the embodiment shown, disengagement is accomplished by the use of an actuator 21. As seen in FIG. 6B, the actuator 21 is a metal bar 21*a* that is actuated by pushing down on a tab 21*b* of the actuator 21 in a direction into the cavity 15 of the receptacle 10. When the tab 21*b* is pushed down, the actuator 21 slides down inside the housing 12 of the receptacle 10. In doing so, a shaped portion of the actuator 21 comes into contact with the latch 20, causing the latch 20 to flex in a direction radially inward inside the cavity 15 of the receptacle 10. As seen in FIG. 6C, when the latch 20 flexes under pressure from the actuator 21, the teeth 20*a* move out of the groove 57 and disengage the lip 56 of the sleeve 40. Once disengaged, the sleeve 40 may be extracted or pulled out of the receptacle 10, thereby disconnecting the microphone connector 1. In this way, the actuator 21 acts to move the latch 20 from an engaged or locked position into a disengaged or unlocked position.

Figure 7B:
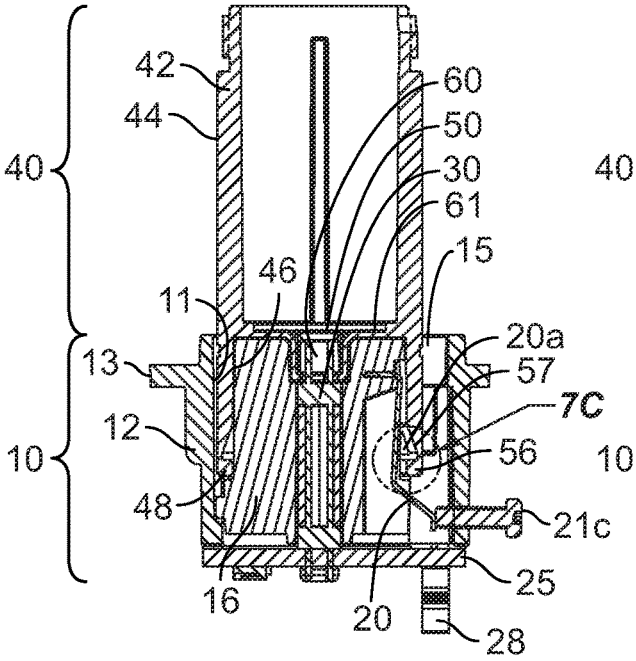
FIG. 7B is a cross-sectional view of the microphone connector of FIG. 7A, taken along section 7B-7B.

Turning to FIGS. 7A-C and 8A-C, operation of an alternative embodiment of a locking mechanism of the microphone connector 1 is depicted. In the depicted embodiment, the locking mechanism comprises a latch 20 which is operated by an actuator 21 which comprises a screw 21*c*. In FIG. 7B, a cross-section of the receptacle 10 (taken along line 7B-7B in FIG. 7A) is depicted, with the sleeve 40 connected to the receptacle 10. As seen in FIG. 7B, the sleeve 40 is inserted into the receptacle 10 until the latch 20 is engaged in a locked position. Specifically, as seen in greater detail in FIG. 7C, the teeth 20*a* of the latch 20 pass along and over the inner wall 11 of the housing 12 of the receptacle 10, until the teeth 20*a* reach a lip 56 formed in the inner surface 46 of the outer shell 42 of the sleeve 40. The resilience of the flexible latch 20 causes it to return to its straightened (non-flexed) state, and in doing so, causes the teeth 20*a* of the latch 20 to enter a groove 57 formed by the lip 56 in the inner surface 46. When the teeth 20*a* enter the groove 57, they engage the lip 56 so as to prevent the sleeve 40 from being removed from the receptacle 10. In this way, the latch 20, tooth 20*a*, lip 56 and groove 57 form and support a locking mechanism of the connector 1.

Figure 8A:
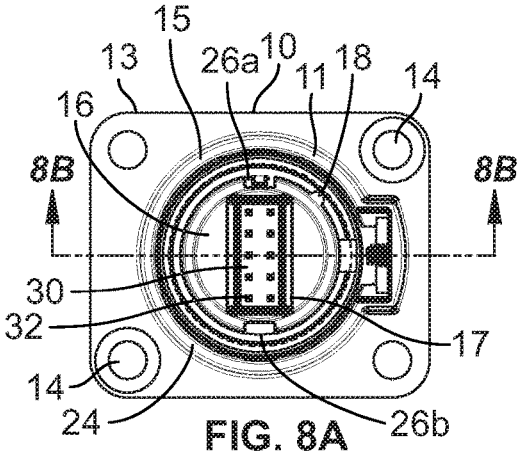
FIG. 8A is a top view of the microphone connector of FIG. 7A, shown in an unlocked or disengaged position.
Figure 8B:
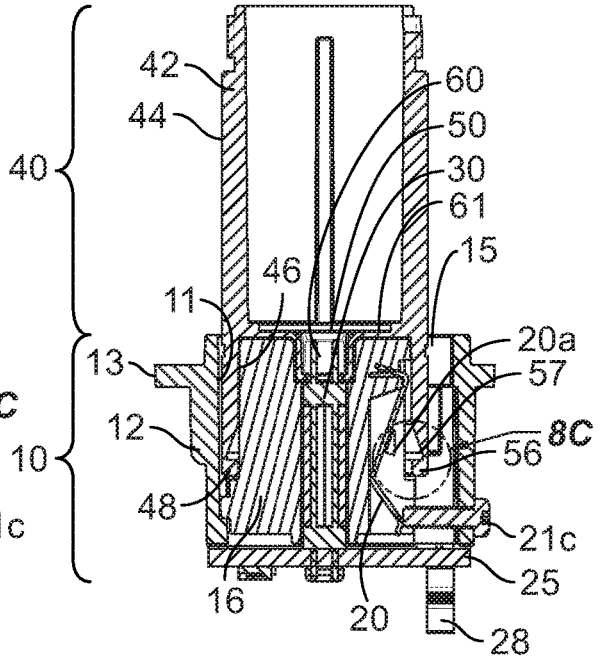
FIG. 8B is a cross-sectional view of the microphone connector of FIG. 8A, taken along section 8B-8B.
Figure 7C:
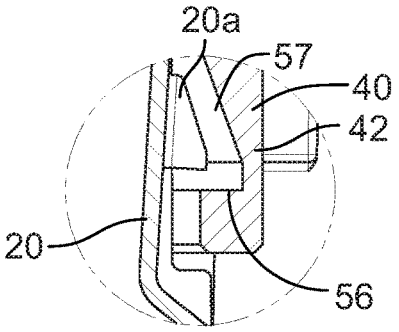
FIG. 7C is an enlarged detail of area 7C of the microphone connector of FIG. 7B.
Figure 8C:
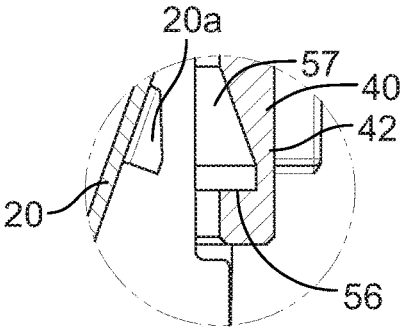
FIG. 8C is an enlarged detail of area 8C of the microphone connector of FIG. 8B.

Removal of the sleeve 40 from the receptacle 10 can only be accomplished by disengagement of the latch 20, as shown in FIG. 8A-C. Disengagement of the latch 20 is largely the reverse of the engagement process. In the embodiment shown, disengagement is accomplished by the use of an actuator 21. As seen in FIG. 8B, the actuator 21 is a screw 21*c* that passes through a hole in the housing 12 of the receptacle. The screw 21*c* is actuated and advanced by tightening the screw 21*c* in the hole, causing the screw 21*c* to extend further into the housing 12, in a direction into the cavity 15 of the receptacle 10. As the screw 21*c* is advanced, the tip of the screw 21*c* comes into contact with the latch 20, causing the latch 20 to flex in a direction radially inward inside the cavity 15 of the receptacle 10. As seen in FIG. 8C, when the latch 20 flexes under pressure from the screw 21*c*, the teeth 20*a* move out of the groove 57 and disengage the lip 56 of the sleeve 40. Once disengaged, the sleeve 40 may be disengaged or pulled out of the receptacle 10, thereby disconnecting the microphone connector 1. In this way, the actuator 21 acts to move the latch 20 from an engaged or locked position into a disengaged or unlocked position.

Figure 9A:
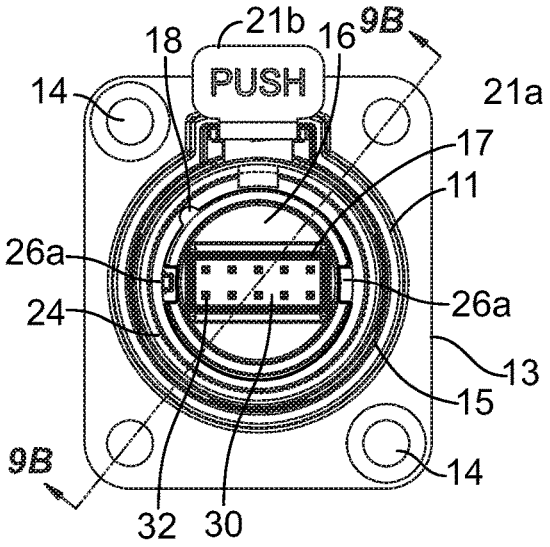
FIG. 9A is a top view of a receptacle of an embodiment of the present invention.
Figure 9B:
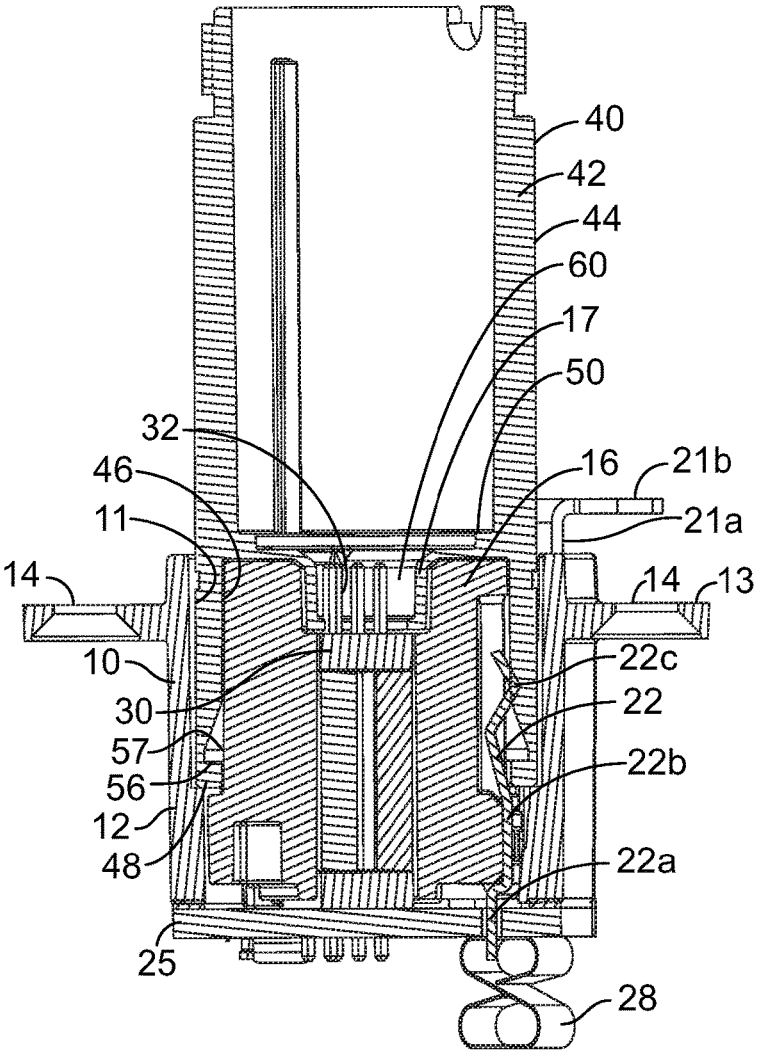
FIG. 9B is a cross-sectional view of the receptacle of FIG. 9A taken along section 9B-9B, showing a contactor of the receptacle.

Turning to FIGS. 9A and 9B, detailed views of the configuration and operation of a contactor 22 of the receptacle 10 is shown. As described in relation to FIG. 4, the contactor 22 is an element of the receptacle 10 that ensures grounding electrical contact between the various components of the receptacle 10, including the housing 12 and the frame 16, and the components of the sleeve 40 for improved electromagnetic shielding and immunity. The contactor 22 is preferably made of metal and forms a flexible, resilient metal strip which is inserted into the receptacle 10 during assembly and manufacture, as described. A first end 22*a* of the contactor 22 is electrically connected to the grounding tab 28 on the bottom surface of the receptacle 10. This electrical connection can be made through any appropriate electrical connection, including by soldering the components together, connecting them with an intermediary wire or other conductor, brazing them together, or otherwise placing them in electrical communication directly or through intermediary components. In the embodiment shown, the first end 22*a* of the contactor 22 extends beyond the bottom of the receptacle 10 and is connected with the grounding tab 28. In this way, the first end 22*a* of the contactor 22 protrudes through the PCB 25 to connect to the grounding tab 28 on the opposing surface of the PCB 25.

A middle portion 22*b* of the contactor 22 makes physical contact with the frame 16 of the receptacle 10, as seen in FIG. 9B. Thus, the contactor 22 extends into the cavity 15 of the receptacle 10 such that the middle portion 22*b* of the contactor 22 contacts the frame 16 of the receptacle 10, as shown. A top portion 22*c* of the contactor 22 is in contact with the sleeve 40, when the sleeve 40 is inserted into the receptacle 10. Specifically, as the outer shell 42 of the sleeve 40 is inserted into the cavity 15 of the receptacle 10, an inner surface 46 of the outer shell 42 makes contact with the top portion 22*c* of the contactor 22, thereby flexing the contactor 22 radially inward into the cavity 15. The resilience of the contactor 22 causes the top portion 22*c* of the contactor 22 to maintain contact with the inner surface 46 of the outer shell 42 of the sleeve 40, due to its tendency to return to its straightened, unflexed position.

The outer surface 44 of the outer shell 42 of the sleeve 40 is in contact with the inner wall 11 of the housing 12 of the receptacle 10, as seen in FIG. 9B. Thus, the contactor 22 forms an electrically conductive connection between the sleeve 40, the housing 12, and the frame 16 to ensure that these components are in contact with the grounding tab 28 on the bottom of the receptacle 10. In this way, the contactor 22 aids in forming a grounding envelope for the microphone connector 1, by ensuring that the housing 12, frame 16, and outer shell 42 of the sleeve 40 are all grounded to the grounding tab 28. In alternative embodiments, the contactor 22 may directly contact the housing 12, for example, via the inner wall 11 of the housing 12.

Other configurations of the contactor 22 are also possible, and may comprise a plurality of metal strips geometrically positioned to make contact with the sleeve 40, frame 16, housing 12 and grounding tab 28. Alternatively, the contactor 22 may be constructed of non-metal materials, such as resilient plastic, which are embedded with, coated, or otherwise includes conductive portions such as metal strips, pathways or other conductors thereon to accomplish the electrical conductivity and grounding described. By using the contactor 22, when downstream electrical equipment is connected to the microphone connector 1, such equipment may be grounded to the grounding tab 28, thereby ensuring that all of the components of the microphone connector 1, as well as any microphones 80 connected thereto, are properly grounded.

In FIGS. 10A through 10E, a keying system of the microphone connector 1 is depicted. The keying system operates to ensure that the sleeve 40 of the microphone connector 1 is insertable into the receptacle 10 in only one direction or orientation, such that the electrical connections of the electrical blocks 30,60 are properly made. In various embodiments, one or both of the sleeve 40 and the receptacle 10 include engageable and mating protrusions and keyways to ensure proper orientation of the sleeve 40 and receptacle 10 relative to one another during insertion, connection, and locking, as described in reference to the example embodiments.

Figure 10B:
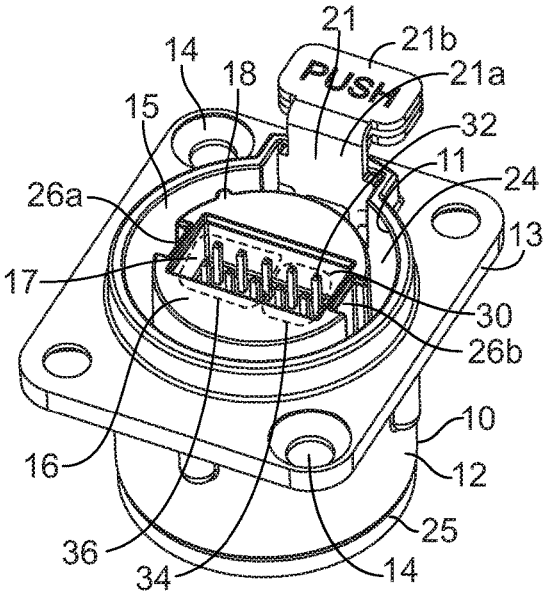
FIG. 10B is a perspective end view of a receptacle of the microphone connector of FIG. 10A, showing a keying system of the microphone connector.
Figure 10C:
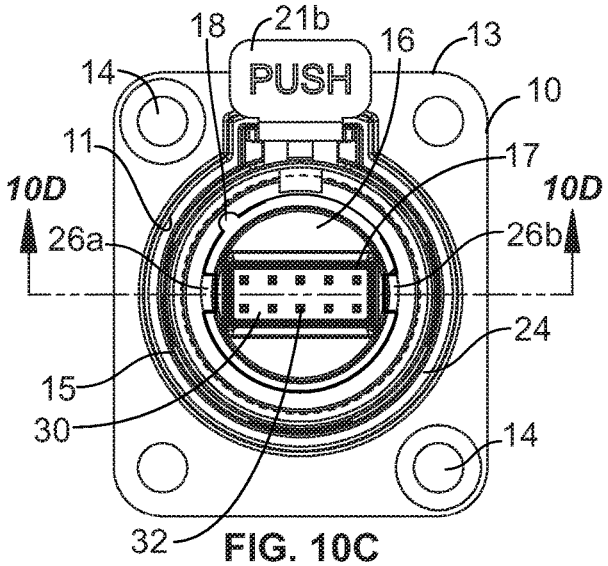
FIG. 10C is a top view of the receptacle of the microphone connector of FIG. 10B.

As seen in FIGS. 10A through 10E, in an embodiment, the receptacle 10 includes a protrusion 18. Turning to FIG. 10B, the protrusion 18 is located inside of the cavity 15, and on the frame 16 of the receptacle 10. Specifically, the protrusion 18 is on an outer surface of the frame 16, and extends lengthwise down the frame 16 in a direction of insertion of the sleeve 40 into the receptacle 10. The protrusion 18 extends radially from the a center of the frame 16, outward into the cavity 15, and has a generally curved or rounded surface. As seen in FIG. 10A, a complimentary keyway 54 is provided in the sleeve 40, and has a similar curved or rounded configuration so as to mate with the protrusion 18. In the embodiment shown, the keyway 54 comprises a channel or groove in the outer shell 42 of the sleeve 40. As seen in FIG. 10A, the keyway 54 is formed in an inner surface 46 of the outer shell 42 of the sleeve 40. However, in alternative embodiments, the keyway 54 may be located in or on other structures of the sleeve 40 and positioned so as to be engaged by the protrusion 18 when the sleeve 40 is inserted into the receptacle 10.

To ensure directional alignment of the sleeve 40 and receptacle 10, the keying system may include a second protrusion/keyway combination. Thus, as seen in FIG. 10B, the receptacle 10 also includes a plurality of keyways 26*a*,26*b* that are engageable by complimentary protrusions 58*a*,58*b* on the sleeve 40. In the embodiment shown, the keyways 26*a*,26*b* are formed in the frame 16 of the receptacle 10, on opposing sides of the first electrical block 30. As shown, the keyways 26*a*,26*b* are grooves or channels formed in the outer surface of the frame 16, and extending axially down a length of the frame 16 in a direction parallel to the direction of insertion of the sleeve 40 into the receptacle 10. In this way, the keyways 26*a*,26*b* are positioned within the cavity 15 of the receptacle 10.

Depicted in FIG. 10A are complimentary protrusions 58*a*,58*b* which are provided on the sleeve 40 to engage the keyways 26*a*,26*b*. In the embodiment shown, the protrusions 58*a*,58*b* are formed inside the second cavity 52 of the sleeve 40, inside of the outer shell 42 of the sleeve 40. More specifically, in this embodiment, the protrusions 58*a*,58*b* are formed on an inner surface 46 of the outer shell 42 of the sleeve 40. The protrusions 58*a*,58*b* protrude radially inward from the inner surface 46 of the outer shell 42, into the second cavity 52. Moreover, the protrusions 58*a*,58*b* extend axially along the inner surface 46 in a direction parallel to a direction of insertion of the sleeve 40 into the receptacle 10. Thus, the protrusions 58*a*,58*b* generally have a length similar to a length of the second cavity 52.

Figure 10E:
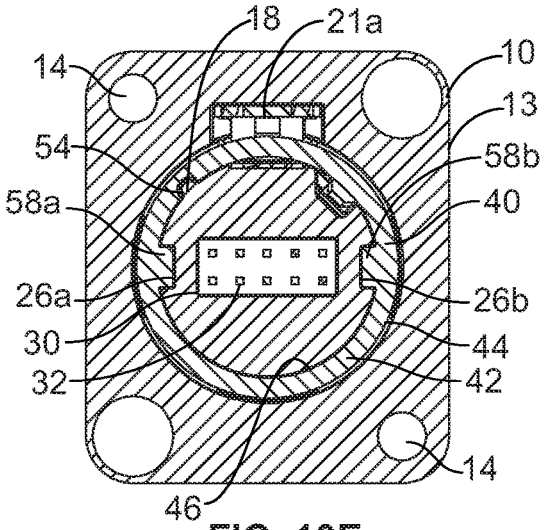
FIG. 10E is a cross-sectional view of the microphone connector of FIG. 10D taken along section 10E-10E, showing the keying system of the sleeve and receptacle.
Figure 10D:
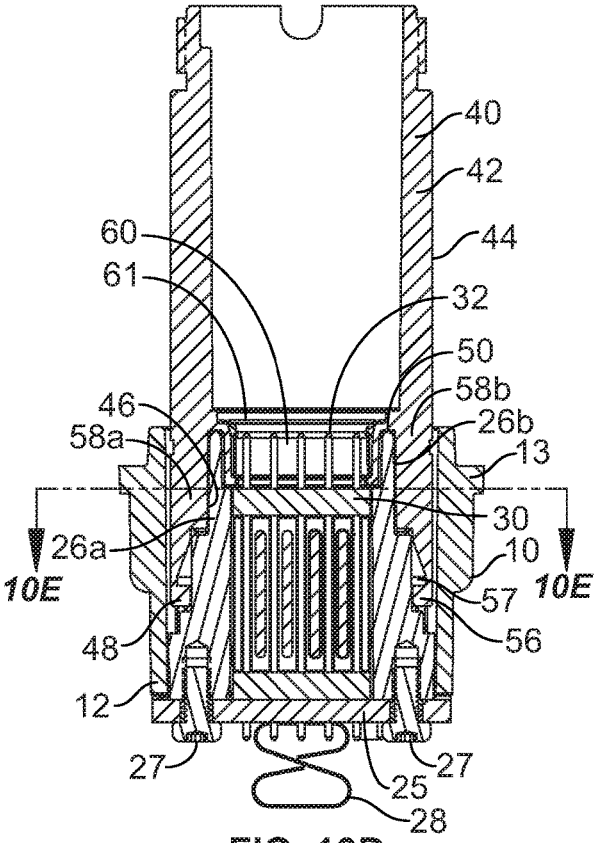
FIG. 10D is a cross-sectional view of the microphone connector of FIG. 10C taken along section 10D-10D, showing the keying system of the sleeve and receptacle.

As seen in greater detail in FIGS. 10D and 10E, when the sleeve 40 is inserted into the receptacle 10, the sleeve 40 must be rotationally aligned around its center axis with the receptacle 10 to allow the protrusion 18 of the receptacle 10 to align with the keyway 54 of the sleeve 40, and to allow the protrusions 58*a*,58*b* of the sleeve 40 to align with the keyways 26*a*,26*b* of the receptacle 10. Only in this alignment will the sleeve 40 be able to be inserted into the receptacle 10 to allow the microphone connector 1 to be connected and placed in an engaged, or locked position. In any other rotational alignment, the protrusions 18,58*a*,58*b* will impede and prohibit insertion of the sleeve 40 into the receptacle 10 by contacting and interfering with other structures inside the cavities 15, 52 of the components.

In this way, the keying system of protrusions 18,58*a*,58*b* and keyways 26*a*,26*b*,54 ensure rotational alignment of the sleeve 40 and receptacle 10 prior to and during insertion and connection. This protects the microphone connector 1 from damage and undue wear and tear, ensuring that the electrical blocks 30,60 are aligned so that the contacts 32,62 therein make proper connections with one another, the contactor 22 properly engages the sleeve 40, and the latch 20 properly engages the latch engaging structures on the sleeve 40, such as the lip 56 and groove 57. This consistent alignment will provide greater robustness to the electrical and mechanical connections of the microphone connector 1, and provide longer usable life of the connector 1, less failures, damage or repairs, and improved reliability and performance. While the keying system in the depicted embodiments includes keyways and mating protrusions, other keyway systems may be used in addition to, as alternatives to, the keyways/protrusions.

In FIG. 11, a microphone 80 which utilizes a microphone connector 1 of the present invention is shown. In the embodiment shown in FIG. 11, the sleeve 40 of the connector 1 is connected with, or integrally formed within an end 82 of the microphone 80. The functionality of the microphone 80 resides in the head 81 of the microphone, which is located proximate a top 83 of the microphone. At the head 81, the microphone 80 includes a cap 84 at the top 83 of the microphone 80. The head 81, further includes a cartridge housing 93, at the bottom of the head 81. Thus, the components of the head 81 are positioned within the cap 84 and the cartridge housing 93, and shown in an exploded view in FIG. 11.

The cap 84 serves to protect the interior components of the microphone 80. In an embodiment, the cap 84 may comprise a screen or apertures to permit acoustic waves from a proximate sound source (such as a human speaking) to enter the microphone 80 and be picked up by the microphone 80. The cap 84 may be affixed to the microphone 80 body by any number of mechanical techniques, but in an embodiment, a set screw 85 passes through a hole in the cap 84 to hold the cap 84 onto the top 83 of the microphone 80.

The microphone 80 further comprises a cartridge 86, which is a transducer element which picks up acoustic waves from an audio source proximate the microphone 80 and covers such acoustic waves to audio signals which are transmitted by the microphone 80 via the connector 1. The cartridge 86 may be any appropriate form of transducer, such as a dynamic or condenser microphone cartridge or transducer. The cartridge 86 is electrically connected to the electrical block 60 of the sleeve 40, so as to be able to transmit audio picked up by the cartridge 86, via the microphone connector 1, to the downstream audio components, such as an amplifier, mixer, etc. The cartridge 86 is secured to the microphone 80 via a retainer ring 87 that acts to mechanically connect the cartridge 86 to the other components of the assembly. The cartridge 86 is in electrical connection with a field effect transistor interface (or FET) 88. The FET 88 acts to control the cartridge 86, and the transmission of the signals received by the cartridge 86. The retainer ring 87 connects the FET 88 and the cartridge 86 so as to maintain mechanical contact between the two.

The microphone 80 also comprises one or more lights 90, which in an embodiment are positioned near the top 83 of the microphone 80 so as to be visible by a user of the microphone 80 near the head 81. In the embodiment shown in FIG. 11, the lights 90 are light emitting diodes (or LEDs), which are formed in the shape of annular ring, or LED ring. The LEDs 90 forming the ring are supported by and connected to an underlying printed circuit board (lighting PCB) 91, which is electrically connected (via wires) to the electrical block 60 of the sleeve 40. The lighting PCB 91 receives electrical signals upstream from the control equipment (not shown) of the system, which transmits lighting signals to the electrical block 30 of the receptacle 10, and via the electrical connection between the two blocks 30,60, to the electrical block 60 of the sleeve 40 to which the wires are connected, and further to the lighting PCB 91 to activate the LEDs 90. Thus, various control equipment, such as computers, processors, hardware, software, and other components, may be used to activate the lighting elements of the LEDS 90 to show a status or mode of the microphone 80, when in use. The LEDS 90 and lighting PCB 91 are connected to, but spaced from the FET 88 by an intermediate spacer 89 positioned between the PCB 91 and the FET 88.

The components of the head 81 are positioned inside of the cap 84 and the cartridge housing 93 when assembled. When the LEDs 90 and lighting PCB 91 are positioned within the cartridge housing 93, the LED ring 90 aligns with a window 94 in the cartridge housing 93. The window 94 is a transparent or translucent portion of the cartridge housing 93 which allows the light from the LED ring 90 to be visible from outside of the cartridge housing 93, while simultaneously protecting the LED ring 90 and lighting PCB 91 from elements external to the microphone 80. In other embodiments, the window 94 may be positioned in other portions of the microphone 80, or may be omitted by positioning the LEDs 90 external to the microphone 80 structure so as to be visible by users of the microphone 80.

The microphone 80 further includes a microphone body 95, which in an embodiment comprises a shaft 95, such as a flexible gooseneck shaft. In other embodiments, the shaft 95 may be rigid, or a combination of flexible and rigid portions. The shaft 95 comprises a hollow tube which supports the head 81 of the microphone 80 away from the end 82 of the microphone 80 where the sleeve 40 is located. The shaft 95 may take on a variety of geometric configurations, lengths, widths, and thicknesses depending on the application in which the microphone 80 is being used. In an embodiment, the shaft 95 is long, thin member for use in a microphone 80 which is surface mounted to a lectern, desk, conference table, or other surface. In alternative embodiments, the microphone body 95 may take on various other geometries and configurations depending on the application of the microphone 80. For example, a desktop microphone 80 may have a generally flat microphone body 95 which sits on the desktop or other appropriate surface and houses the other components of the microphone 80.

An interior channel of the hollow shaft 95 accommodates an electrical cable 96 which connects the electrical components in the head 81 of the microphone 80 (such as the cartridge 86, FET 88, LEDS 90 and lighting PCB 91) with the electrical block 60 of the sleeve 40. The end of the electrical cable 96 in the head 81 of the microphone 80 is supported by a bushing 92, which may be a crimp bushing affixed to the cable 96 to keep the cable 96 positioned within the head 81, specifically within the cartridge housing 93. A bushing 92 abuts a portion of the interior of the cartridge housing 93 and prevents the cable 96 from being inadvertently strained or pulled out of the housing 93. The cable 96 may be alternatively secured to the head 81 of the microphone 80 and the cartridge housing 93 in a variety of other ways, including soldering, clamping, and the like. The electrical cable 96 comprises a plurality of wires which connected the functional components in the head 81 of the microphone 80 to the electrical block 60 in the sleeve 40. The wires of the electrical cable 96 and their functionality is described in greater detail in relation to FIG. 12.

Figure 12:
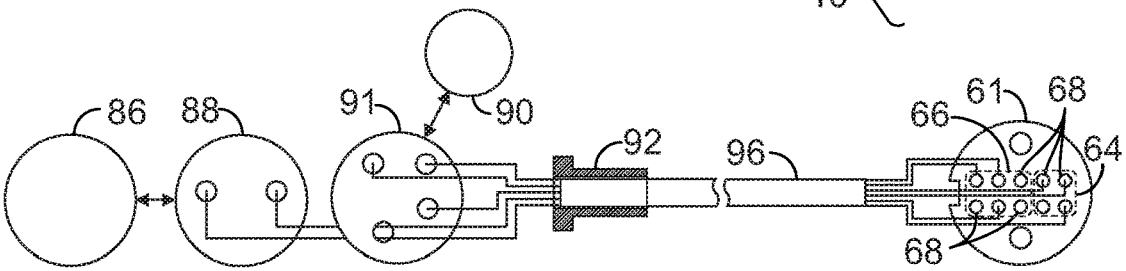
FIG. 12 is a wiring diagram of the microphone of FIG. 11.

In FIG. 12, an electrical diagram of an embodiment of the microphone 80 and microphone connector 1 of the present invention is shown. Specifically, FIG. 12 depicts the electrical connections between the PCB 61 of the sleeve 40 (which is connected to the second electrical block 60), the lighting PCB 91 (which is in communication with the LEDs 90), and the FET 88 (which is in communication with and controls the cartridge 86). The electrical block 60 includes a plurality of contacts 62, which include audio contacts 64 and lighting contacts 66 which are terminated on the PCB 61 of the electrical block 60. The audio contacts 64 are connected to the FET 88 via wires that pass through the electrical cable 96 and enable functionality of the cartridge 86. Sound waves received at the cartridge 86 are converted to electrical signals, and transmitted to the FET 88, sent down corresponding wires in the electrical cable 96 to the audio contacts 64 of the electrical block 60 of the sleeve 40. When the sleeve 40 is connected to the receptacle 10, as described herein, the electrical block 60 of the sleeve 40 is in electrical communication with the electrical block 30 of the receptacle 10. Thus, the audio signals are transmitted to corresponding audio contacts 34 of the receptacle 10, and in turn to other audio components of the system connected via the PCB 25 of the receptacle 10 (such as amplifiers, mixers, etc.). In this way, the electrical wiring of the microphone 80 supports downstream transmission of audio signals from the cartridge 86 across the connector 1 via the electrical blocks 30,60.

Similarly, the lighting contacts 66 of the electrical block 60 of the sleeve 40 are connected to the LED ring 90 via the lighting PCB 91 to enable operation of the lights in the LED ring 90. Thus, lighting control signals received via the lighting contacts 66 are transmitted to the lighting PCB via wires in the electrical cable 96 as seen in FIG. 12. In response to the lighting signals, the lighting PCB 91 operates the lights in the LED ring 90 so as to cause the LEDs 90 to illuminate so as to transmit information as to a status or mode of the microphone 80. When the sleeve 40 is connected to the receptacle 10, as described herein, a downstream control system sends lighting control signals upstream to the receptacle 10 through wires connected to the PCB 25 of the receptacle 10. Those lighting signals are in turn transmitted across the electrical block 30 of the receptacle 10 to the electrical block 60 of the sleeve, via their corresponding lighting contacts 36,66. The lighting signals received at the electrical block 60 of the sleeve 40 are further transmitted upstream to the lighting PCB 91 to control the illumination of the LEDs 90. In this way, the microphone connector 1 acts in a bidirectional manner so as to send audio signals picked up by the cartridge 86 of the microphone 80 downstream to audio devices connected to the receptacle 10, while simultaneously sending lighting control signals from control systems connected to the receptacle 10 upstream to the lighting PCB 91 and LEDs 90 of the microphone 80 to illuminate the LEDs 90.

Figure 13:
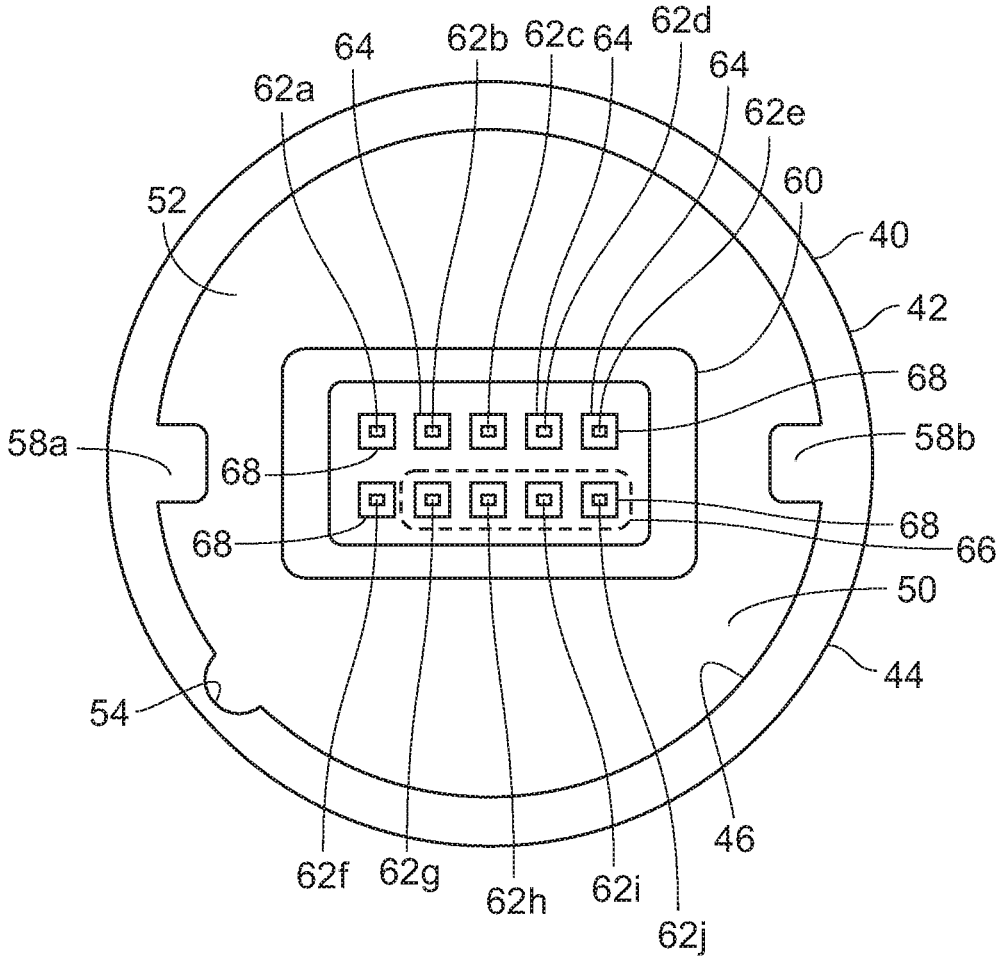
FIG. 13 is an end view of an electrical block of the sleeve of an embodiment of the present invention, showing contact assignments and functionality.

Turning to FIG. 13, an embodiment of an end view of the sleeve 40 is depicted, for which the various functions of the electrical block 60 thereon are explained. As with other embodiments, the electrical block 60 of the sleeve 40 is positioned within the cavity 52 of the sleeve 40, and supported by the support 50. The electrical block 60 is in communication with a PCBA (not shown) of the sleeve 40, which is in communication with the various electrical contacts 62 of the electrical block 60 so as to pass along received electrical signals to other components of a microphone connected to the sleeve 40. In the embodiment shown, the electrical block has ten (10) contacts 62*a-j*, which are located in corresponding contact positions 68 formed in the electrical block 60. The contact positions 68, and hence the contacts therein 62*a-j*, are arranged in a rectangular array, forming a matrix having two rows and five columns, or a "2×5" matrix, as seen in FIG. 13.

In this embodiment, the ten contacts 62*a-j* have various functions. The specific function of each contact 62*a-j* is shown below in Table 1.

TABLE 1

| Contact | Function |
|---|---|
| 62a | Microphone Identifier 2 |
| 62b | Capsule Supply Voltage |
| 62c | Microphone Capsule 2 Audio |
| 62d | Microphone Identifier 1 |
| 62e | Microphone Capsule 1 Audio |
| 62f | Ground |
| 62g | Lighting Supply Voltage |
| 62h | Light 1 Control |
| 62i | Light 2 Control |
| 62j | Light 3 Control |

Thus, the various contacts 62*a-j* in Table 1 are connected to the PCB (not shown) of the sleeve 40, which in turn routes signals there from to appropriate components in the sleeve 40 and connected microphone (such as the microphone 80 in FIG. 11). The contacts 62*a-j* include audio contacts 64, as well as lighting contacts 66. The contacts 62*a-j* may optionally include information contacts such as the microphone identifier contacts 62*a,d*.

In the embodiment shown in FIG. 13, the lighting contacts 66 include the lighting supply voltage 62*g*, and the light controls 62*h,i,j* for a plurality of lights. The lighting supply voltage 62*g* supplies an operational voltage to lights onboard of the microphone, which in an embodiment may be +10.5V DC. The lighting control contacts 62*h,i,j* serve to send control signals to a plurality of lights on the microphone, so as to activate the lights by turning them on, turning them off, flashing them, etc. Thus, the three light control contacts 62*h,i,j* in the embodiment shown can operate three separate lights on the microphone (such as blue LED, a green LED, and a red LED, respectively).

In the embodiment shown in FIG. 13, the audio contacts 64 include the capsule supply voltage 62*b*, and two microphone capsule audio channels 62*c,e*. The capsule supply voltage 62*b* provides an input voltage to one or more microphone cartridges or capsules in the microphone connected to the sleeve 40. Thus, in an embodiment, the capsule supply voltage 62*b* supplies +5V DC to the microphone cartridges. The electrical block 60 in FIG. 13 supports a microphone having up to two cartridges. Thus, the contacts 62 include a first microphone capsule audio channel 62*e* and a second microphone capsule audio channel 62*c*. These microphone capsule audio channels return audio which is picked up by a first and second microphone cartridge on board of the microphone connected to the sleeve 40.

The block 60 in FIG. 13 may optionally include one or more information contacts, such as contacts 62*a* and 62*d*. In this embodiment, the information contacts 62*a,d* are microphone identifier contacts 62*a,d*, which are in communication with the microphone(s) and cartridge(s) connected to the sleeve 40. The microphone identifier contacts 62*a,d* return an identification signal which relays information as to what type of microphone and/or cartridge is connected to the sleeve 40. This way, a control system connected on the receptacle 10 side of the connector 1 will know what types of microphones and/or cartridges are connected to the sleeve 40 side of the connector 1. In other embodiments, other information can be transmitted via the information contacts to share data as to configurations, components, statuses, modes, and operations of the connector 1 and the components connected thereto.

In some embodiments, the various keyway/protrusion combinations perform complimentary functions. For example, in the embodiment shown in FIGS. 10A and 10B, the keyway 54 on the sleeve 40 and the protrusion 18 on the receptacle 10 are relatively small in size and serve primarily as a locating mechanism to ensure proper alignment of the sleeve 40 with the receptacle 10 prior to and during insertion of the sleeve 40 into the receptacle 10. The keyway 54 and protrusion 18 generally have an arced shape or surface, and have a substantially semi-circular cross-section. This keyway 54 and protrusion 18 are substantially smaller in size than the second keyway/protrusion combination on the connector 1—namely, the keyways 26*a*,26*b* in the receptacle 10 and the mating protrusions 58*a,b* on the sleeve 40. Thus, this keyway 54 and protrusion 18 combination serves primarily (or in some embodiments, solely) as a locating mechanical device for alignment during insertion.

The keyways 26*a,b* in the receptacle 10 (and the corresponding protrusions 58*a*,58*b* in the sleeve 40) are larger, more robust mechanical engaging structures which are have a generally rectangular cross-section. These complimentary structures, therefore, may serve not only to align the sleeve 40 and receptacle 10 during insertion—but also provide structural support and rigidity to the connector 1 when the sleeve 40 and receptacle 10 are connected. Thus, when the two portions of the connector 1 are inserted into one another, the mechanical engagement of the protrusions 58*a*,58*b* with the keyways 26*a,b* provide resistance to twisting, bending, flexing and other transverse forces on the connector—and in this way, serve to provide mechanical support to the connector 1 while the sleeve 40 is inside of the receptacle 10. Thus, these keyway 26*a,b* and protrusion 58*a*,58*b* combinations serve the purpose of both locating (during insertion) and supporting (after insertion). Therefore, depending on the size, shape, length, geometry, tolerances, and configuration of the keyways/protrusions, they may either serve primarily (or solely) as locating keyway/protrusion combinations, or as combined locating and supporting keyway/protrusion combinations.

Using the connections of the microphone connector 1, control systems may be coupled to the receptacle 10 to control the lighting 90 on the microphone 80 connected via the sleeve 40, so as to indicate a status or mode of the microphone 80. For example, when the microphone 80 is "on" or "active", the control system may cause the LEDs 90 to light a certain color (such as green) to indicate that the microphone 80 is active and picking up sound via the cartridge 86. This visual indication of "green" serves to inform a user of the microphone 80 that he or she may now speak into the microphone 80 because it is turned on and is active. In another example, the control system may cause the LEDs 90 to light a different color (such as red) to indicate that the microphone 80 is "off" or "inactive" to indicate that the microphone 80 is in a "mute" mode. This visual indication of "red" serves to inform a user of the microphone 80 that sounds are not being picked up by the microphone 80 because of its "muted" state.

In other embodiments, the LEDs 90 may be illuminated by the control system in a large variety ways to provide a number of visual indicators corresponding with various statuses or modes of the microphone 80. The LEDs 90 may be illuminated in different colors corresponding with various modes or statuses. Alternatively, the LEDs 90 may be illuminated in different illumination patterns (such as solid illumination, short flashes, long flashes, blinking, etc.) to indicate differing statuses or modes in which the microphone 80 has been placed. By using the LEDs 90, the control system can visually indicate various information to users of the microphone 80. In larger systems with large numbers of microphones 80, control systems can take advantage of the large variety of colors and illumination patterns to convey a wealth of information about the statuses and modes of the microphones 80 of such system to the many users of such system.

The locking and keying features of the microphone connector 1 described herein provide a robust mechanical connection which ensures a durable and solid electrical connection for optimal use of the microphone 80. The keyways and protrusions described herein ensure that the sleeve 40 is inserted into the receptacle 10 in the proper orientation such that the electrical blocks 30,60 are properly connected, and the correct pairing of counterpart audio contacts 34,64 and lighting contacts 36,66 occurs. Moreover, the latch 20 mechanism works in conjunction with the lip 56 and groove 57 of the sleeve 40 to keep the sleeve 40 and receptacle 10 connected. This prevents inadvertent disconnection of the connector 1 during use, for example, when bumped or contacted by a user or other objects. While providing a robust electromechanical connection, the latch 20 simultaneously supports easy disconnection of the sleeve 40 from the receptacle 10 via the actuator 21. When a user wishes to remove or disconnect a microphone 80, he or she simply actuates the actuator 21 to disengage the latch 20, placing the connector 1 in unlocked state, and permitting removal of the sleeve 40 from the receptacle 10. This functionality supports easy removal of the microphone 80, for example, for servicing, maintenance, repair, or replacement. The disengagement further allows for a variety of microphones 80 to be used, and to have differing varieties of microphones 80 quickly and easily swapped out and replaced by disconnecting unwanted microphones 80 and reconnecting alternative microphones 80 to the various available receptacles 10 of a system.

Moreover, construction, configuration, and various components of the microphone connector 1 of the present invention support delivery of high quality audio signals by microphones 80 using such connectors 1. The microphone connector 1 provides excellent shielding from unwanted electrical and radio frequency interference, for example, from cellular phones which are active proximate to the microphones 80 and microphone connectors 1. The metal construction of the receptacle 10 support such improved shielding. Moreover, the contactor 22 positioned between the frame 16 and the housing 12 of the receptacle 10 and the sleeve 40 ensures excellent grounding of the entire receptacle 10 to the grounding tab 28, and creates a "grounding envelope" around the components of the receptacle 10 and sleeve 40, including the electrical blocks 30,60 therein. These and other features of the connector 1 minimize the impact of outside electrical and radio frequency devices, thereby preserving the high audio quality captured by the microphone 80.

The electrical blocks 30,60 used in the microphone connector 1 may be any variety of appropriate electrical connectors, plugs, jacks, or terminations. Preferably, the electrical blocks 30,60 are insulated such that the contacts 32,62 therein, once connected, are insulated from the other components of the microphone connector 1, such as the housing 12 and frame 16 of the receptacle 10, and the outer shell 42 and support 50 of the sleeve 40. In an embodiment, the electrical blocks 30,60 are mating plastic components (such as a plug and a jack) which house the internal contacts 32,62 therein. The contacts 32,62 may connect to wires which can be connected to other external components. Alternatively, the contacts 32,62 may connected to printed circuit boards where external connections may be made. The use of insulated electrical blocks 30,60 ensures that the audio signals being passed downstream by the audio contacts 32,62 and the lighting signals being passed upstream by the lighting contacts 34,64 of the electrical blocks 30,60 are not affected by outside unwanted electromagnetic interference, nor do the lighting signals and audio signals affect one another. When coupled with the grounding and shielding properties of the sleeve 40 and receptacle 10, the microphone connector 1 provides an excellent conduit for the audio and lighting signals via the insulated electrical blocks 30,60 and insulated wires and/or conductors connected thereto.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A microphone comprising:
- a head, the head including a cartridge;
- a microphone body supporting the head;
- a sleeve connected to the microphone body, the sleeve comprising:
  - an outer shell;
  - a cavity formed within the outer shell; and
  - a first electrical block positioned within the cavity, the first electrical block comprising an array of contact positions configured to house a plurality of electrical contacts, wherein the array is a rectangular array and comprises ten contact positions arranged in a 2 by 5 matrix.

2. The microphone of claim 1, further comprising a keyway formed on an inner surface of the outer shell.

3. The microphone of claim 2, wherein the keyway has a generally arced surface and comprises a locating mechanism.

4. The microphone of claim 1, further comprising a protrusion extending from an inner surface of the outer shell.

5. The microphone of claim 4, wherein the protrusion has a generally rectangular cross-section and comprises a structural mechanism.

6. The microphone of claim 1, wherein the first electrical block includes first and second audio contacts within the contact positions of the first electrical block.

7. The microphone of claim 6, wherein the first and second audio contacts are in communication with the cartridge and are configured to transmit audio channel signals.

8. The microphone of claim 1, wherein the first electrical block includes first, second, third, and fourth lighting contacts within the contact positions of the first electrical block.

9. The microphone of claim 8, wherein the first, second, third, and fourth lighting contacts are positioned in the same row of the 2 by 5 matrix.

10. The microphone of claim 8, further comprising a light, wherein the first, second, third, and fourth lighting contacts are in communication with the light and are configured to transmit lighting supply voltage and lighting control signals.

11. The microphone of claim 1, wherein the first electrical block includes a supply voltage contact within the contact positions of the first electrical block, wherein the supply voltage contact is in communication with the cartridge and is configured to transmit a supply voltage.

12. The microphone of claim 1, wherein the first electrical block includes first and second information contacts within the contact positions of the first electrical block.

13. The microphone of claim 12, wherein the first and second information contacts are configured to transmit identification signals that denote a type of one or more of the microphone or the cartridge.

14. The microphone of claim 1, wherein the sleeve is insertable into a receptacle, the receptacle comprising:

a housing, a second cavity formed in the housing, a frame positioned within the second cavity; and a second electrical block supported by the frame and positioned within the second cavity;

wherein the sleeve is insertable into the receptacle such that the first and second electrical blocks engage one another.

15. A connector sleeve comprising:

an outer shell;

a cavity formed within the outer shell;

a keyway formed on an inner surface of the outer shell;

a first electrical block positioned within the cavity, the first electrical block comprising an array of contact positions configured to house a plurality of electrical contacts, wherein the array is a rectangular array and comprises ten contact positions arranged in a 2 by 5 matrix; and a first protrusion extending from the inner surface of the outer shell.

16. The connector sleeve of claim 15, wherein the first electrical block further includes a plurality of audio contacts within the contact positions of the first electrical block.

17. The connector sleeve of claim 15, wherein the first electrical block further includes a plurality of lighting contacts within the contact positions of the first electrical block.

18. The connector sleeve of claim 15, wherein the keyway has a generally arced surface and comprises a locating mechanism.

19. The connector sleeve of claim 15, wherein the first protrusion has a generally rectangular cross-section and comprises a structural mechanism.

20. The connector sleeve of claim 15, wherein the sleeve is insertable into a receptacle, the receptacle comprising:

a housing, a second cavity formed in the housing, a frame positioned within the second cavity;

a second protrusion formed on the frame; and a second electrical block supported by the frame and positioned within the second cavity;

wherein the sleeve is insertable into the receptacle such that the second protrusion enters the keyway, and the first and second electrical blocks engage one another.

* * * * *